United States Patent [19]

Marsh

[11] Patent Number: 4,874,336

[45] Date of Patent: Oct. 17, 1989

[54] SHIELDED ELECTRICAL CONNECTOR FOR PRINTED CIRCUIT BOARD MOUNTING

[75] Inventor: Edward K. Marsh, Kernersville, N.C.

[73] Assignee: AMP Incorporated, Harrisburg, Pa.

[21] Appl. No.: 168,360

[22] Filed: Mar. 15, 1988

[51] Int. Cl.[4] ..... H01R 13/648

[52] U.S. Cl. ..... 439/607; 439/737

[58] Field of Search ..... 439/607-610, 439/95, 96, 97, 98, 99, 108, 901-906, 55, 78, 81-83, 737

[56] References Cited

U.S. PATENT DOCUMENTS

| | | | |
|---|---|---|---|
| 2,810,069 | 5/1974 | Jaconette, Jr. . | |
| 4,506,937 | 3/1985 | Cosmos et al. | 339/14 R |
| 4,521,062 | 6/1985 | Kurbikoff et al. | 439/607 |
| 4,619,493 | 10/1986 | Kibuta | 439/607 |
| 4,643,509 | 2/1987 | Hollyday et al. | 439/607 |
| 4,679,883 | 7/1987 | Assini et al. | 439/607 |
| 4,688,868 | 8/1987 | Noyes | 439/607 |
| 4,721,473 | 1/1988 | DelGuidice et al. . | |

FOREIGN PATENT DOCUMENTS 0180284 10/1985 European Pat. Off. .

OTHER PUBLICATIONS

Holmberg Electronics Product Line Catalog, 1986, p. 49.

*Primary Examiner*—David Pirlot

*Attorney, Agent, or Firm*—Eric J. Gruen

[57] ABSTRACT

A shielded electrical connector is shown which includes an insulating housing having electrical terminals for interconnection to a printed circuit board and for interconnection to a similar electrical connector. The shield member is drawn to include a shroud which covers a shroud on the insulative housing. The insulative housing includes a mounting flange including two flange ends which are profiled for receiving two U-shaped mounting clips. The U-shaped clips include two legs extending from a portion of the clip for electrical connection to a printed circuit board grounding pad. The clip also includes a threaded portion which can mount the connector to a panel and which is used for commoning the shield to the U-shaped clip.

2 Claims, 4 Drawing Sheets

PRIOR ART 6
40
38
52
58
114
30
42
36
54
56
104
102
108
106
100

SHIELDED ELECTRICAL CONNECTOR FOR PRINTED CIRCUIT BOARD MOUNTING

BACKGROUND OF THE INVENTION

1. Field of the Invention

The subject invention relates to a shielded electrical connector which can be mounted within a panel and to a printed circuit board.

2. Description of the Prior Art

Electrical connectors are available for voice and data transmission which include insulating housings with densely arranged electrical terminals which mate with like terminals in complementary connectors; see for example U.S. Pat. No. 3,760,335. These type connectors are also available in shielded form where the shield member is formed from a drawn or cast housing, see for example U.S. Pat. No. 4,398,780. Retention features, such as that shown in U.S. Pat. No. 4,721,473, are included to temporarily mount a connector to a printed circuit board prior to soldering. These members also interconnect the shield members of the connectors to grounding pads or traces on the printed circuit board.

Shielded electrical connectors are also available which are panel mountable and which have posts which are electrically connectable to the ground traces on printed circuit boards. For example, FIG. 1 shows a shielded electrical connector which is commercially available which includes a cast shield member S having a mating face G for mounting directly to the face of a panel. Fastening means such as screws are insertable through the panel and into holes in the posts P which are threaded from the face G. A printed circuit board is mountable to the face I of the housing H and the terminals T are soldered to the traces on printed circuit board, while the posts P are soldered to ground traces on the printed circuit board.

To retain the connector housing H and the cast shield member together prior to insertion on the printed circuit board, a plastic insert is included which is insertable through the opening in the forward mating face of the shield member S which interferingly fits within the housing H. The insert includes a flange whic his larger the the mating face of the shield member S which retains the shield S and the housing H together. Once the connector is soldered to the printed circuit board, the plastic insert is not necessary as the shield member S traps the housing H between the printed circuit board.

SUMMARY OF THE INVENTION

It is an object of the invention to design a less expensive shield member for mounting to the housing.

It is a further object of the invention to design means for retaining the shield and the housing together when in an unassembled fashion.

It is an object of the invention to design a less expensive means to mount the shield connector to the printed circuit board which also grounds the shield member to the ground traces on a printed circuit board.

The above mentioned objects were accomplished by designing a connector which comprises an insulative housing having a flange means which supports the housing for mounting purposes and further includes a shroud extending forwardly from the flange thereby defining a front mating face. Shielding means is included which is profiled for receipt over the shroud of the housing and over a front face of the flange means. A retention member is also included which comprises a clip portion for receipt over a portion of the flange means, and includes retention means extending from the clip portion for electrical connection to a grounding pad on a connectable printed circuit board.

In the preferred embodiment of the invention the clip portion is U-shaped, and is received over an end of the flange means at each end of the housing.

In the preferred embodiment of the invention the clip portion comprises a plate portion and a strap portion which is reversely bent around the plate portion to define the U-shape, and the retention means extend from the strap portion.

In the preferred embodiment of the invention the ends of the flange are recessed and profiled to flushly receive the respective plate portions and strap portions.

In the preferred embodiment of the invention, the plate portions include threaded portions which are hemisherically shaped, and which face the strap portion, while the recess for the plate portion further comprises a hemisherically shaped recess for receipt of the threaded portions.

In the preferred embodiment of the invention the shield means and the housing include apertures therethrough aligned with each other and with the threaded portions of the retention means, whereby when a matable fastening means is received through the shield means and the housing means, and the fastening means is drawn taut, the threaded portion draws the plate portion adjacent to the shield means for effective electrical connection between the retention means and the shield means.

BRIEF DESCRIPTION OF THE DRAWINGS

FIG. 3 is a cross-sectional view through lines 2—2 of FIG. 1.

DETAILED DESCRIPTION OF THE PREFERRED EMBODIMENT

Figure 1:
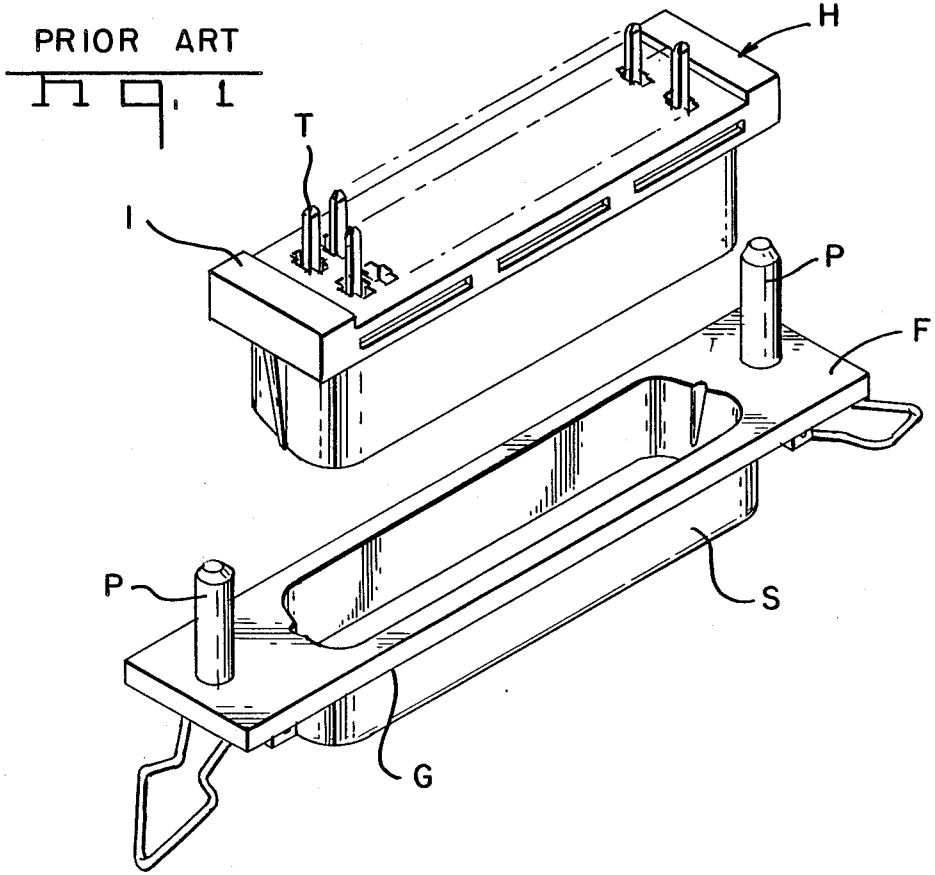
FIG. 1 is an isometric view of a prior art connector.
Figure 2:
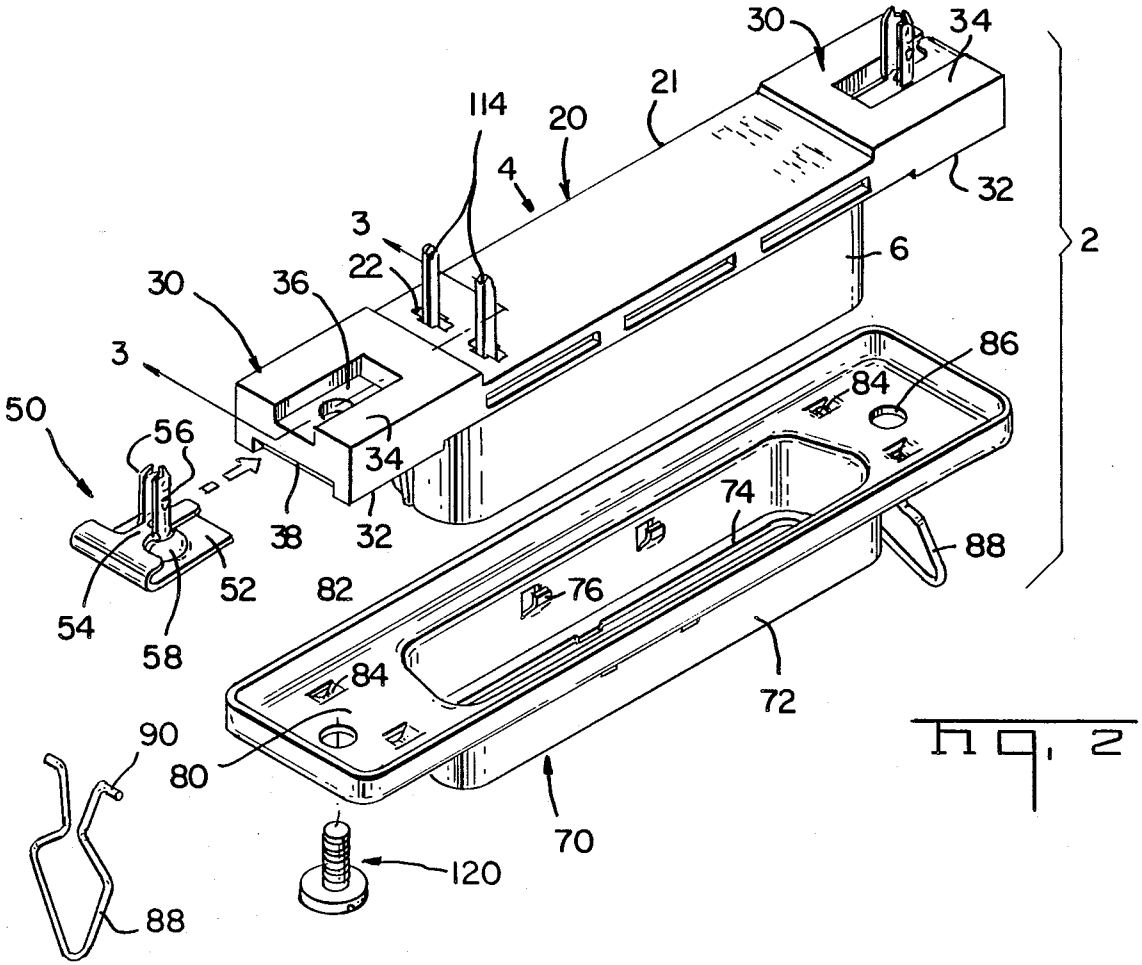
FIG. 2 is an isometric view showing the components of the shielded electrical connector of the subject invention exploded one from the other.
Figure 7:
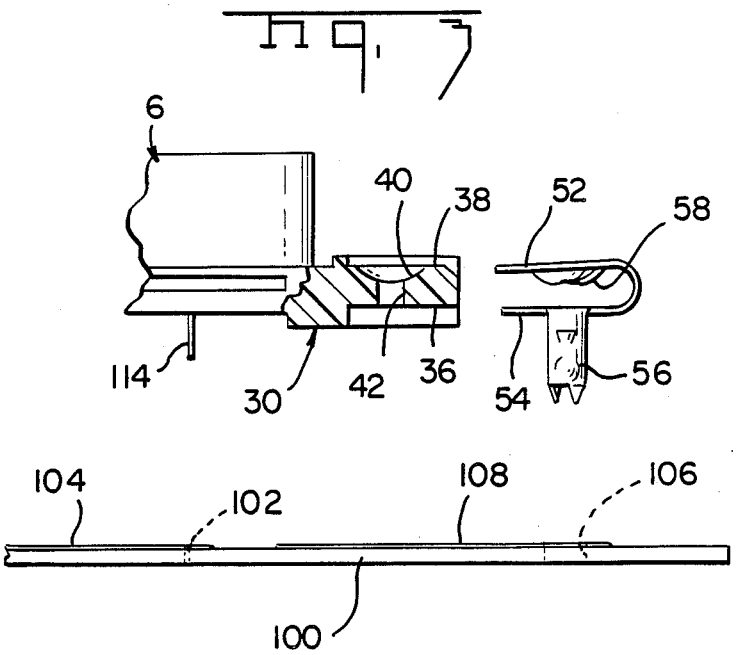

Referring first to FIG. 2, the shielded electrical connector 2 of the instant invention generally comprises an insulative housing shown generally as 4, two retention and grounding members 50, and a shielding member shown generally as 70. the electrical connector 2 of the subject invention is similar, and is matable with an electrical connector similar to that shown in U.S. Pat. No. 3,760,335 to Roberts, the subject of which is incorporated herein by reference.

Figure 4:
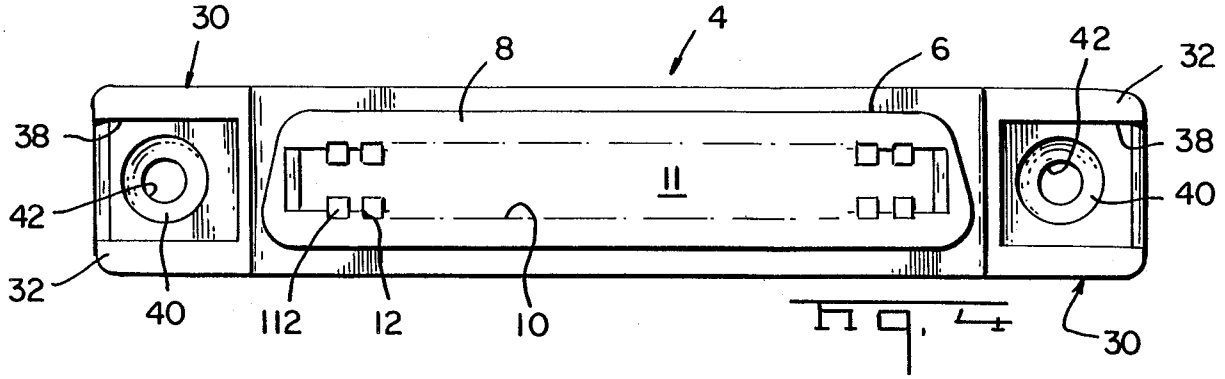
FIG. 4 is a front plan view of the housing of the subject invention.
Figure 5:
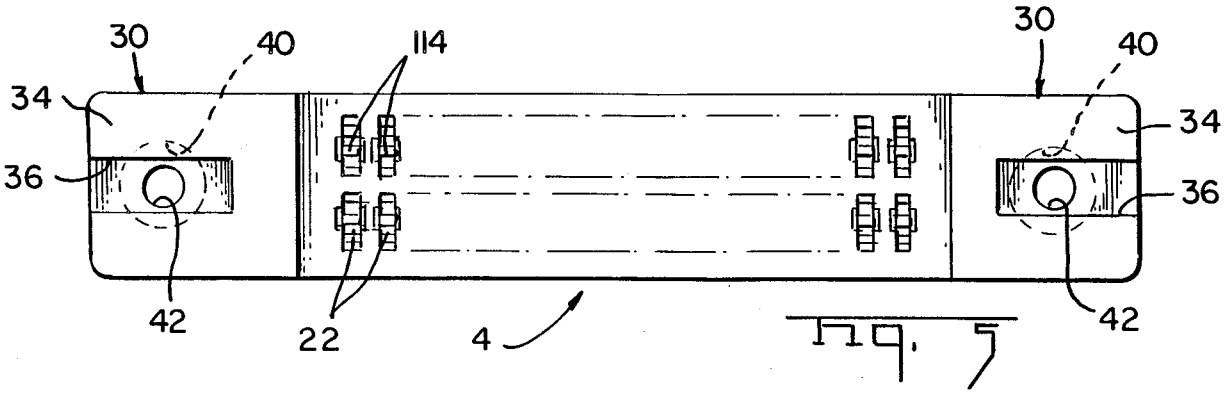
FIG. 5 is rear plan view of the housing of the instant invention.

Referring now to FIG. 4, the housing 4 generally comprises a shroud member 6 which is a peripheral wall which defines the D-shaped profile for mating interconnection with like connectors. The shroud 6 defines a front mating face 8 and defines an opening 10 within the front portion of the housing member, as shown in FIG. 4. The opening 10 extends from the front mating face 8 rearwardly to a rear wall 11 which is also integral with the insulative housing 4. The forward shroud 6 extends forwardly from a flange member 20 which is also an integral structure with the housing 4, and extends lengthwise of the shroud for mounting purposes to the printed circuit board. As shown in FIG. 2, the flange 20 includes a recessed surface 21 including a plurality of apertures 22 which extend through the rear wall 11 and are aligned with the apertures 12 (FIG. 4) for mounting of the terminals 110. The flange member 20 comprises flange ends 30 extending from opposite ends of the recessed surface 21. Each flange end generally comprises an inner surface 32 and an outer surface 34 where the inner surface 32 includes a recessed channel 38 (FIG. 4) and the outer surface 34 includes a recessed channel 36. The recessed channel 38 further includes a hemispherically shaped recess 40, as best shown in FIG. 3. An aperture 42 projects through the hemispherical recess 40 and through the recessed channel 36.

Retention and grounding members 50 generally include a plate portion 52 with a strap portion 54 which is reversely bent about the plate portion 52 to form a U-shaped clip. A threaded member 58 is formed into a generally hemispherically shaped dome which faces the strap portion 54. Two retention legs 56 extend from the strap portion away from the plate portion. The two retention legs 50 are similar to those described in U.S. Pat. No. 4,721,473, incorporated herein by reference.

The shield member 70 is preferably a drawn metal member formed from a uniplanar sheet of metal and includes a forward shroud portion 72 which is also D-shaped for defining the mating profile of mating connectors, and is profiled for receipt over the insulative shroud 6 of the housing 4. The forward portion of the shroud is formed into an overlapping portion thereby defining a rearwardly facing shoulder 74 for abutting engagement with the front mating face 8 of the insulative housing. The shroud portion further includes stamped spacer legs 76 for spacing the outer portion of the shroud 6 relative to the shield member 70. The shield member 70 further includes an integral plate 80 which is substantially planar and is profiled for mating abutment with the interface 32 of the flange member 20. The shield member 70 further includes a peripheral wall 82 which extends from the plate member 80 for substantailly surrounding the flange portion 20 of the insulative housing. It should be noted, however, that the walls 82 are profiled such that they do not extend to the face 34, thereby preventing shorting of ground traces on a printed circuit board. The plate portion 80 further includes two apertures at opposite ends which are aligned with the threaded member 58 and with the aperture 42 in the flange ends 30. The flange member 70 further comprises drawn brackets 84 which provide means for mounting the feet 90 of the retention clips 88.

The subject invention is assembled by installing the plurality of terminals 110 through the respective apertures 22 and 12 until the resilient contact portions 112 are adjacent to the front mating face and the rear mounting tails 114 extend from the recessed surface 21. Each flange end 30 then receives a retention and grounding member 50 which is clipped over the end such that the strap portion 54 is received within the recess 36 and the plate portion 52 is received within the recess 38. It should be noted that the hemispherically shaped threaded portion 58 is profiled for engagement with the hemispherically shaped recess 40 which retains the retention and grounding members 50 to the insulative housing 4. The shielding member is then installed over the shroud member 6 until the front mating face 8 of the shroud engages the rearwardly facing shoulder 74 of the shield member. To retain the shielding member 70 to the insulative housing, a fastener member such as 120 is insertable through the apertures 86 of the shield member and is threadably interconnectable with the threads of the member 58. Advantageously, as the fastener 120 is drawn taut, the plate portion 52 is drawn towards the plate member 80 to provide an effective electrical interconnection between the plate portion 52 and the plate portion 80 of the shield member 70. This provides for an excellent electrical interconnection between the shield member 70 and a ground trace which is located on a printed circuit board.

To place the electrical connector on a printed circuit board such as 100, the electrical connector is placed on the board such that the two retention features such that the two retention legs 56 are inserted through the apertures 106 of the printed circuit board and each of the mounting tabs 114 of the terminals 110 are inserted into respective apertures 102 on the printed circuit board. The electrical connector can then be wave soldered, reflow soldered, or the like, which interconnects the retention and grounding members 50 to the ground traces 108 and interconnects the electrical terminals 110 with respective circuit traces 104. The assembly of the printed circuit board and connector can be installed within a panel such that the connector is adjacent to an opening, and the panel includes apertures for receipt of fastener members such as 120.

The subject invention was described by way of preferred embodiment and should not be taken to limit the scope of the claims which follow.

I claim:

1. A shielded electrical connector of the type for mounting on printed circuit boards comprises:

an insulative housing having a flange means which supports the housing for mounting purposes and includes a shroud extending forwardly from the flange thereby defining a front mating face;

shielding means profiled for receipt over the shroud of the housing and over a front face of the flange means;

a retention member comprising a U-shaped clip portion received over an end of the flange means at each end of the housing, and including retention means extending from the clip portion for electrical connection to a grounding pad on a connectable printed circuit board, each U-shaped clip portion comprising a plate portion and a strap portion, where each plate portion comprises a hemisherically shaped threaded portion facing the strap portion and lying within a recess on the front face of the flange means, and each hemisherically shaped threaded member is lying within a hemisherically shaped portion of the recess, and the strap portion is lying within a further recess on a rear side of the flange, and the retention means extending from the strap portions; and securement means, comprising threaded members cooperable with the threaded portions of the retention members and the shielding means to effect electrical contact between the retention members and the shielding means.

2. The connector of claim 1 wherein the shield means and the housing include apertures therethrough aligned with each other and with the threaded portions of the retention means, whereby when a matable fastening means is received through the shield means and the housing means, and the fastening means is drawn taut, the threaded portion draws the plate portion adjacent to the shield means for effective electrical connection between the retention means and the shield means.

* * * * *